US007340074B2

(12) United States Patent
Chalupper

(10) Patent No.: US 7,340,074 B2
(45) Date of Patent: Mar. 4, 2008

(54) DEVICE AND METHOD TO ADJUST A HEARING DEVICE

(75) Inventor: Josef Chalupper, Paunzhausen (DE)

(73) Assignee: Siemens Audiologische Technik GmbH, Erlangen (DE)

( * ) Notice: Subject to any disclaimer, the term of this patent is extended or adjusted under 35 U.S.C. 154(b) by 274 days.

(21) Appl. No.: 10/789,923

(22) Filed: Feb. 27, 2004

(65) Prior Publication Data

US 2004/0208331 A1 Oct. 21, 2004

(30) Foreign Application Priority Data

Feb. 27, 2003 (DE) ..... 103 08 655

(51) Int. Cl.
*H04R 25/00* (2006.01)

(52) U.S. Cl. ..... 381/315; 381/312

(58) Field of Classification Search ..... 381/312, 381/315, 316, 317, 318, 320, 321, 314; 702/57
See application file for complete search history.

(56) References Cited

U.S. PATENT DOCUMENTS 4,548,082 A 10/1985 Engebretson et al.
4,731,850 A * 3/1988 Levitt et al. ..... 381/320
4,972,487 A * 11/1990 Mangold et al. ..... 381/315

FOREIGN PATENT DOCUMENTS

DE 44 38 976 A1 5/1996

* cited by examiner

*Primary Examiner*—Brian Ensey
(74) *Attorney, Agent, or Firm*—Schiff Hardin LLP

(57) ABSTRACT

The individual adaptation of a hearing device to a hearing device user is simplified by providing that the hearing device user manually selects the amplification in a specific auditory situation and initiates an adjustment event, such that this auditory situation is physically measured. From this, a new characteristic line field is determined, such that a corresponding amplification can be adjusted in a new auditory situation. Via this possibility of the self-adjustment, it is no longer necessary that the hearing device user seeks out an acoustician for adjustment.

14 Claims, 2 Drawing Sheets

DEVICE AND METHOD TO ADJUST A HEARING DEVICE

BACKGROUND OF THE INVENTION

The present invention concerns a method to adjust a hearing device via an input of a desired setting in the hearing device at a determinable point in time. Moreover, the present invention concerns a corresponding device to adjust a hearing device.

The settings of hearing devices, particularly those concerning the amplification and compression, is nowadays in many cases achieved via adaptation formulas on the basis of audiometric data. The hearing loss, the discomfort threshold, the volume scaling and the like are considered as audiometric data. The adaptation formulas are based on statistical and empirical perceptions and therefore have only conditional validity for the individual hearing device user. In particular, a time-consuming post-treatment at the hearing device acoustician is therefore necessary for the optimal adjustment of the frequency-dependent and level-dependent amplification. A further problem is that the optimal setting of the hearing device for the user is only found in, and can only be verified in, realistic acoustic situations relevant to the user.

So far, an individual, optimal setting was only iteratively found in repeated visits to the hearing device acoustician. However, since specific acoustic situations can only insufficiently be used as a basis at the acoustician, the settings thus found frequently turn out to be less fitting in real situations. Specifically, the typical spatial sound field frequently existing for the user, or the individual requirements of the hearing device user, can not be adjusted or, respectively, considered in artificial acoustic situations.

SUMMARY OF THE INVENTION

The object of the present invention is thus to be able to respond to individual conditions in the setting of a hearing device.

This object is inventively achieved via a method for adjusting a hearing device via an input of a desired setting value in the hearing device at a determinable point in time; measurement of at least one sound quantity concerning a first environment situation at the determinable point in time; automatic learning of settings values to be used, dependent on the desired setting value and the at least one measured sound quantity; new measurement of at least one sound quantity concerning a second environment situation; and adjustment of the hearing device to one of the setting values to be used with regard to the second environment situation.

Moreover, a device is inventively provided to adjust a hearing device, with an input device to input a desired setting value in the hearing device at a determinable point in time; a measurement device to measure at least one sound quantity concerning a first environment situation at the determinable point in time; and a computer to automatically learn setting values to be used, dependent on the desired setting value and the at least one measured sound quantity concerning the first environment situation; whereby one of the setting values to be used with regard to the second environment situation is output by the computer.

Embodiments of the invention make it possible that the user directly (i.e., not via a hearing device acoustician) communicates with his hearing device and fine-tunes or adjusts it himself, corresponding to the communicated information and under consideration of physical measurement quantities.

Various embodiments are described below. In an embodiment, the input preferably ensues via a button belonging to the hearing device, via the volume controller, via the remote control and/or via a speech input device. It is thereby sufficient to specify a pulse for storage on the hearing device. A selected (e.g. via pressing a button) amplification can therewith be stored together with an acoustic environment situation.

The at least one measure sound quantity can be the minimum or maximum sound pressure level in a frequency channel, or the modulation depth. The amplification or, respectively, compression can be readjusted as a setting value using the measurement quantities acquired in individual situations.

The learning preferably ensues via temporal weighting of learning steps. It can therewith be determined whether and how quickly the "self-adjustment" should converge.

The learning steps can be implemented at predetermined point in time and/or in a predetermined number. A learning step can also be executed on individual demand by, e.g. the hearing aid user. The learning can therewith ensue with the desired speed and precision.

An inventive adjustment device is preferably integrated directly into a hearing device, such that the adjustment or adaptation of the hearing device can ensue without an expenditure on equipment. However, for reasons of space, it can be necessary (especially in what are known as in-the-ear hearing devices) to use for adjustment an external adjustment system in which the adjustment device described above is integrated. The setting values can be transferred from the adjustment system to the hearing device via wires or wirelessly.

DESCRIPTION OF THE DRAWING

Embodiments of the present invention are illustrated by the Figures.

DETAILED DESCRIPTION OF THE INVENTION

The exemplary embodiment subsequently specified in detail represents preferred embodiments of the present invention.

Figure 1:
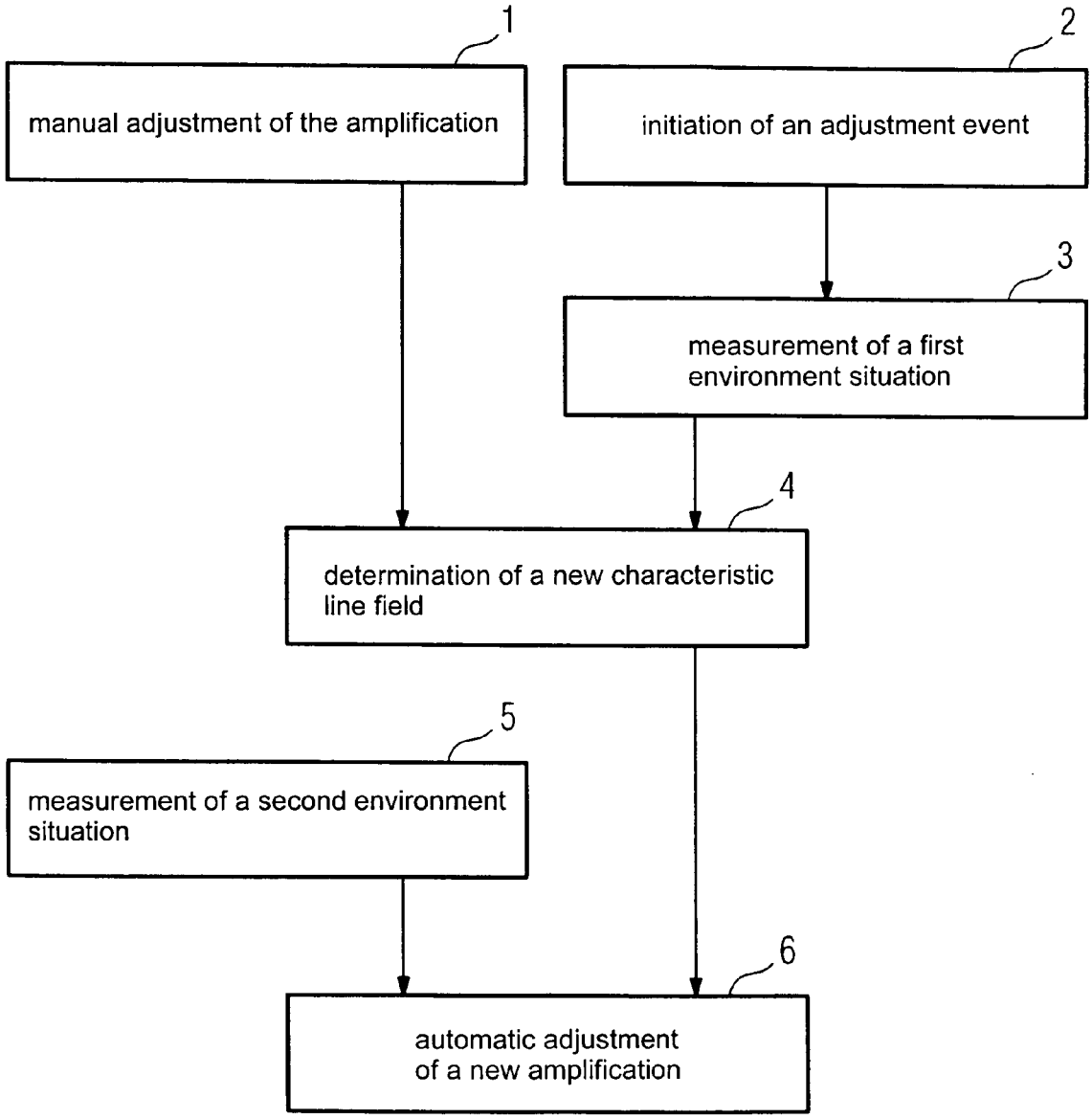
FIG. 1 is a flow diagram according to an embodiment of the inventive method.
Figure 2:
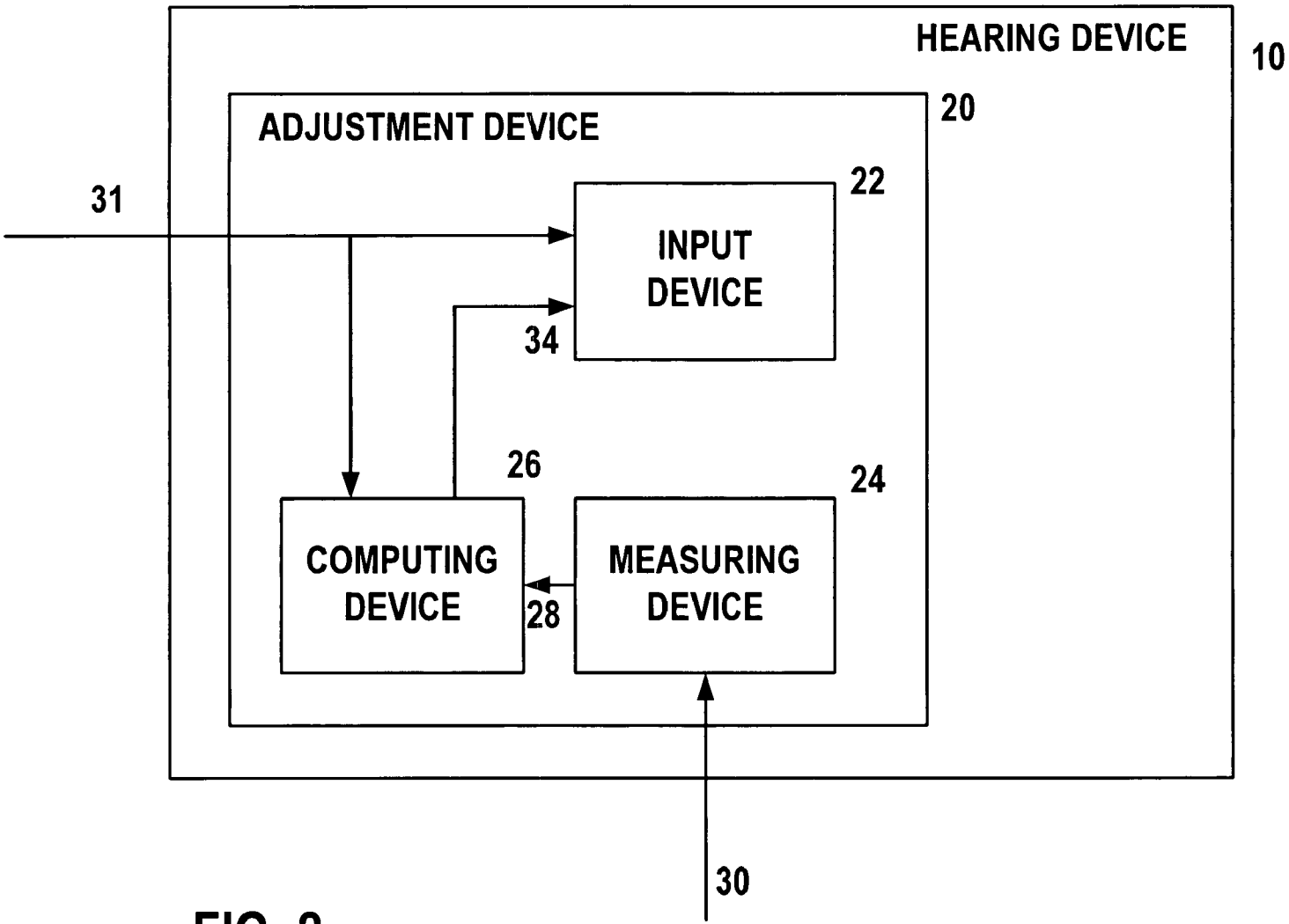
FIG. 2 is a block diagram of the components according to an embodiment of the invention.

Corresponding to the flow diagram shown in the FIG. 1 and the block diagram shown in FIG. 2, according to block 1 the user first sets the amplification on the hearing device 10 when he is located in a specific acoustic situation. In the event that this acoustic situation is characteristic for him, according to block 2 he initiates an adjustment event of his hearing device. This ensues either manually, or temporally controlled in known time intervals, or automatically in another manner. If the adjustment event is initiated, the current environment situation is acoustically measured, as this is shown in block 3.

The acquired measurement values and the manually selected amplification values are drawn upon in order to determined a new characteristic line field according to block 4. A plurality of environment situations with corresponding amplifications is associated in this characteristic line field.

The hearing device user now in a new acoustic environment situation, this is measured according to block 5 using characteristic sound quantities. With the aid of the newly determined characteristic line field (block 4), the hearing device 10 automatically calculates a new amplification matching this new environment situation, as this is indicated in block 6.

An automatic learning/acquisition of a characteristic line field for the hearing device user therewith ensues on the basis of individual auditory situations. With the aid of this hearing device user-specific characteristic line field, the hearing device 10 is now automatically adjusted to the respective acoustic situations as the hearing device user would have manually done it himself. The setting value of the hearing device is thereby not only the amplification selected in the example, but rather if necessary also the compression or other characteristics.

The automatic setting of the hearing device 10 ensues concretely, for example in that, in the acoustic situations relevant to him, the user communicates the desired amplification to his hearing device via, e.g., the volume controller, the remote control, a speech input, etc. Improved values for the amplification and compression are derived by evaluating the required amplification and, existing for the same span of time, a physical analysis of the acoustic situation with regard to, e.g., minimum and maximum sound pressure in the channels of the hearing device, modulation depth, classifier decision, etc. The necessary data are stored in the hearing device or externally, and the evaluation is implemented in the hearing device or externally, for example by way of a PC or remote control.

The evaluation to determine level-dependent and frequency-dependent amplifications can ensue after a specific time, a specific number of control functions, or as desired by the user. Given the determination of the new setting, it can be established via a temporal weighting whether and how quickly the self-adjustment should converge. The hearing device user preferably also has the possibility to influence this temporal weighting in order to implement a corresponding fine adjustment.

The advantageous use of the inventive self-adjustment can be shown in the following example. In situations with strong low-frequency levels, the amplification is reduced by the user, while no changes are stored given middle and low levels. The hearing device 10 thereupon changes the characteristic line field such that the compression ratio is increased in the low-frequency channels.

As a result of self-adjustment, the hearing device user may no longer have to seek out an acoustician. However, this also means that the acoustician no longer needs special expenditure given post-treatment. Moreover, the self-adjustment enables, for example, the direct sale of hearing devices over the Internet.

FIG. 2 illustrates components of the hearing device 10 according to an embodiment of the invention. The hearing device 10 comprises an adjustment device 20 (that may be internal or external) having an input device 22 to input a desired setting value 31 in the hearing device at a determinable point in time. The adjustment device 20 has a measurement device 24 to measure at least one sound quantity from a sound coming from an input 30 representing an acoustic signal concerning a first environment situation at the determinable point in time. The adjustment device 20 further has a computer 26 to automatically learn setting values to be used, dependent on the desired setting value 31 and the at least one measured sound quantity (via an input 28) concerning the first environment situation; whereby one of the setting values to be used with regard to the second environment situation is output 34 by the computer 26.

For the purposes of promoting an understanding of the principles of the invention, reference has been made to the preferred embodiments illustrated in the drawings, and specific language has been used to describe these embodiments. However, no limitation of the scope of the invention is intended by this specific language, and the invention should be construed to encompass all embodiments that would normally occur to one of ordinary skill in the art.

The present invention may be described in terms of functional block components and various processing steps. Such functional blocks may be realized by any number of hardware and/or software components configured to perform the specified functions. For example, the present invention may employ various integrated circuit components, e.g., memory elements, processing elements, logic elements, look-up tables, and the like, which may carry out a variety of functions under the control of one or more microprocessors or other control devices. Similarly, where the elements of the present invention are implemented using software programming or software elements the invention may be implemented with any programming or scripting language such as C, C++, Java, assembler, or the like, with the various algorithms being implemented with any combination of data structures, objects, processes, routines or other programming elements. Furthermore, the present invention could employ any number of conventional techniques for electronics configuration, signal processing and/or control, data processing and the like.

The particular implementations shown and described herein are illustrative examples of the invention and are not intended to otherwise limit the scope of the invention in any way. For the sake of brevity, conventional electronics, control systems, software development and other functional aspects of the systems (and components of the individual operating components of the systems) may not be described in detail. Furthermore, the connecting lines, or connectors shown in the various figures presented are intended to represent exemplary functional relationships and/or physical or logical couplings between the various elements. It should be noted that many alternative or additional functional relationships, physical connections or logical connections may be present in a practical device. Moreover, no item or component is essential to the practice of the invention unless the element is specifically described as "essential" or "critical". Numerous modifications and adaptations will be readily apparent to those skilled in this art without departing from the spirit and scope of the present invention.

REFERENCE LIST

1 manual adjustment of the amplification
2 initiation of an adjustment event
3 measurement of a first environment situation
4 determination of a new characteristic line field
5 measurement of a second environment situation
6 automatic adjustment of a new amplification
10 hearing device
20 adjustment device
22 input device
24 measuring device
26 computing device
28 input of the computing device
30 measuring device input of a signal representing an acoustic signal
31 desired setting value
34 computing device output of a setting value

What is claimed is:

1. A method to adjust a hearing device, comprising:

manually inputting a manually-entered desired setting value in the hearing device by a hearing device user via a user-operable input mechanism at a determinable point in time in a first environment situation;

measuring at least one sound quantity concerning the first environment situation at the determinable point in time;

automatically calculating a new characteristic curve family to be used, depending on the desired setting value and the at least one measured sound quantity in the first environment situation;

wherein a plurality of environment situations with corresponding amplifications is associated in this characteristic curve family;

newly measuring at least one sound quantity related to a second environment situation; and automatically setting the amplification of the hearing device with regard to the second environment situation on the basis of the new characteristic curve family.

2. The method according to claim 1, wherein the at least one measured sound quantity represents a minimum or maximum sound pressure level in a frequency channel, or a modulation depth.

3. The method according to claim 1, wherein the setting value concerns an amplification or compression.

4. The method according to claim 1, wherein the learning ensues via temporal weighting of learning steps.

5. The method according to claim 1, wherein the learning steps ensue according to at least one of: a) at predetermined points in time; and b) in a predetermined number.

6. The method according to claim 1, wherein the learning steps ensue upon demand of a hearing aid user.

7. A device to adjust a hearing device, comprising:

a manually operated input device configured to input a manually-entered desired setting value in the hearing device by a hearing device user at a determinable point in time in a first environment situation;

a measurement device configured to measure at least one sound quantity concerning the first environment situation at the determinable point in time and at least one sound quantity concerning a second environment situation; and a computing device configured to automatically calculate and store a new characteristic curve family, dependent on the manually-entered desired setting value and the at least one measured sound quantity in the first environment situation, to associate a plurality of environmental situations with corresponding amplifications in this characteristic curve family, and to automatically output at an output of the computing device an amplification value based on a newly measured sound quality of a second environment situation and the new characteristic curve family.

8. The device according to claim 7, wherein the input device comprises at least one of a volume controller, a remote control, and a speech input unit.

9. The device according to claim 7, wherein the at least one measured sound quantity represents a minimum or maximum sound pressure level in a frequency channel, or a modulation depth.

10. The device according to claim 7, wherein the setting value concerns an amplification or compression.

11. The device according to claim 7, wherein the computing device is configured to temporarily weigh learning steps.

12. The device according to claim 7, wherein learning steps can be implemented with the computation device according to at least one of: a) at predetermined points in time, and b) in a predetermined number.

13. A hearing device with an adjustment device, the adjustment device comprising:

a manual input device configured to manually input a manually-entered desired setting value in the hearing device at a determinable point in time in a first environment situation;

a measurement device configured to measure at least one sound quantity concerning the first environment situation at the determinable point in time and at least one sound quantity concerning a second environment situation; and a computing device configured to automatically calculate a new characteristic curve family, dependent on the manually-entered desired setting value and the at least one measured sound quantity in the first environment situation, to associate a plurality of environmental situations with corresponding amplifications in this characteristic curve family, and to automatically output at an output of the computing device an amplification value based on a newly measured sound quality of a second environment situation and the new characteristic curve family.

14. An adjustment system with an adjustment device to which a hearing device can be connected via wires or wirelessly, the adjustment device comprising:

a manually operated input device configured to input a manually-entered desired setting value by a hearing device user in the hearing device at a determinable point in time in a first environment situation;

a measurement device configured to measure at least one sound quantity concerning the first environment situation at the determinable point in time and at least one sound quantity concerning a second environment situation; and a computing device configured to automatically calculate and store a new characteristic curve family, dependent on the manually-entered desired setting value and the at least one measured sound quantity in the first environment situation, to associate a plurality of environmental situations with corresponding amplifications in this characteristic curve family, and to automatically output at an output of the computing device an amplification value based on a newly measured sound quality of a second environment situation and the new characteristic curve family.

* * * * *